US006954201B1

(12) United States Patent
Ludden et al.

(10) Patent No.: US 6,954,201 B1
(45) Date of Patent: Oct. 11, 2005

(54) DATA BUS SYSTEM AND PROTOCOL FOR GRAPHICS DISPLAYS

(75) Inventors: Christopher A. Ludden, Pittsford, NY (US); Donald E. Camp, Peoria, AZ (US); Richard Alexander Erhart, Tempe, AZ (US); Bruce C. Moore, Glendale, AZ (US); Mark Kuhns, Peoria, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 277 days.

(21) Appl. No.: 10/289,471

(22) Filed: Nov. 6, 2002

(51) Int. Cl.[7] ..... G09G 5/00
(52) U.S. Cl. ..... 345/204; 345/214; 345/215
(58) Field of Search ..... 345/204, 214, 345/215

(56) References Cited

U.S. PATENT DOCUMENTS

| | | | | |
|---|---|---|---|---|
| 5,233,446 | A * | 8/1993 | Inoue et al. | 345/87 |
| 6,067,061 | A * | 5/2000 | Friedman | 345/74.1 |
| 6,177,922 | B1 * | 1/2001 | Schiefer et al. | 345/698 |
| 6,335,778 | B1 * | 1/2002 | Kubota et al. | 349/151 |
| 6,339,413 | B1 * | 1/2002 | Drake et al. | 345/50 |
| 6,529,181 | B2 * | 3/2003 | Nakano et al. | 345/204 |
| 2002/0033811 | A1 * | 3/2002 | Kinoshita | 345/204 |
| 2002/0180718 | A1 * | 12/2002 | La | 345/204 |
| 2003/0043129 | A1 * | 3/2003 | Tazuke | 345/204 |

FOREIGN PATENT DOCUMENTS

WO WO 9963513 A2 * 12/1999

* cited by examiner

*Primary Examiner*—Richard Hjerpe
*Assistant Examiner*—Alexander S. Beck
(74) *Attorney, Agent, or Firm*—Merchant & Gould P.C.; Timothy P. Sullivan

(57) ABSTRACT

The present invention provides a point-to-point data bus architecture and a protocol for a graphics system. The TCON transmits the data to the column drivers using separate point-to-point data buses. Data may be transmitted to the column drivers during a horizontal blanking period resulting in more data being written to the column drivers as compared to a typical graphical display system. As each point-to-point data bus contains only the data for its corresponding column driver the instantaneous data rate to any column driver is lower than in conventional multi-drop architectures. The point-to-point system has fewer printed circuit board (PCB) lines and a lower loop area than a conventional multi-drop system. A protocol may also be implemented. The protocol may provide for system level control and coordination of column drivers and other display system components. This protocol allows the TCON to control the operation of the column drivers without the need for extra PCB lines.

19 Claims, 7 Drawing Sheets

*FIG. 2* *(PRIOR ART)*

*FIG. 5* *(PRIOR ART)*

DATA BUS SYSTEM AND PROTOCOL FOR GRAPHICS DISPLAYS

FIELD OF THE INVENTION

The present invention is related to electronic circuits, and more specifically to data bus systems for graphics displays.

BACKGROUND OF THE INVENTION

Display system Timing Controller (TCON) electronics accept control and data from upstream graphics generation electronics and reformat them to fit the requirements of the row and column drivers used to drive displays. The Data Enable (DE) signal is the control mechanism used to indicate when graphics data is actively being transmitted to the TCON. The DE signal is active (logic one state) when data is being transmitted, and is inactive (logic zero state) during periods when no data is being transmitted. Data is transmitted to the column drivers only when the DE signal is active. The data is transmitted using multi-drop busses requiring many PCB lines. Periods of time in a horizontal line when data is not being transmitted is referred to as horizontal blanking. Lines within a graphics frame when data is not being transmitted are referred to as vertical blanking lines.

SUMMARY OF THE INVENTION

Briefly described, the present invention is directed at providing a point-to-point data bus architecture and a protocol for a graphics system.

According to one aspect of the invention the TCON transmits the data to the column drivers using separate point-to-point data buses. Each data bus can be 2, 3, or 4 data lines wide, although other widths are possible.

According to another aspect of the invention, data may be transmitted to the column drivers during a horizontal blanking period. A PLL is used to provide a clock that is different from the clock provided by a host system. This can result in more data being written to the column drivers as compared to a typical graphical display system.

According to yet another aspect of the invention, the instantaneous data rate to any column driver is lower than in conventional multi-drop architectures. Each point-to-point data bus contains only the data for its corresponding column driver. This results in lower power and lower EMI than conventional multi-drop architectures.

According to still yet another aspect of the invention, the point-to-point architecture offers physical advantages as well. The point-to-point system has fewer printed circuit board (PCB) lines and a lower loop area than a conventional multi-drop system.

According to a further aspect of the invention, the point-to-point architecture may incorporate a protocol for data transmission between the TCON and the column drivers. The ability to transmit data during the Horizontal Blanking period allows time for extra output clocks in which to implement a protocol. The protocol may provide for system level control and coordination of column driver and other display system components. This protocol allows the TCON to control the operation of the column drivers without the need for extra PCB lines. Conventional graphics display systems, on the other hand, typically require one or more control lines (not used for data loading) from the TCON to each column driver.

DETAILED DESCRIPTION OF THE PREFERRED EMBODIMENT

Figure 1:
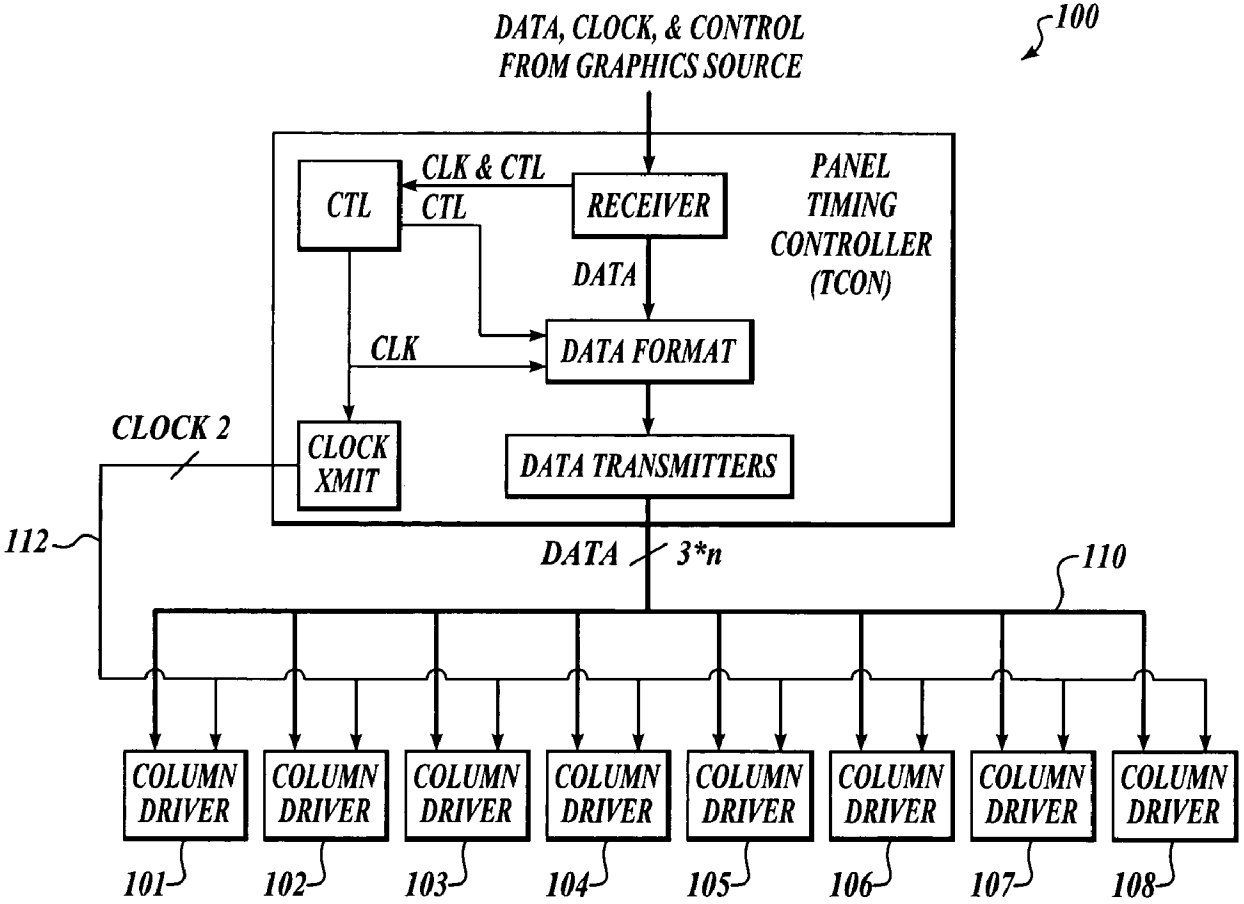
FIG. 1 (PRIOR ART)
FIG. 1 shows a Graphics Display System using a multi-drop data bus architecture between the panel timing controller (TCON) and the column drivers.

In the following detailed description of exemplary embodiments of the invention, reference is made to the accompanied drawings, which form a part hereof, and which is shown by way of illustration, specific exemplary embodiments of which the invention may be practiced. These embodiments are described in sufficient detail to enable those skilled in the art to practice the invention, and it is to be understood that other embodiments may be utilized, and other changes may be made, without departing from the spirit or scope of the present invention. The following detailed description is, therefore, not to be taken in a limiting sense, and the scope of the present invention is defined only by the appended claims.

Throughout the specification and claims, the following terms take the meanings explicitly associated herein, unless the context clearly dictates otherwise. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected or an indirect connection through one or more passive or active intermediary devices. The term "circuit" means either a single component or a multiplicity of components, either active and/or passive, that are coupled together to provide a desired function. The term "signal" means at least one current, voltage, or data signal. The term "DE" means a data enable signal. The term "TCON" refers to a timing controller. Referring to the drawings, like numbers indicate like parts throughout the views.

Briefly described, the present invention is directed at providing a point-to-point data bus architecture and a protocol for a graphics system. The TCON transmits the data to the column drivers using separate point-to-point data buses. Data may be transmitted to the column drivers during a horizontal blanking period resulting in more data being written to the column drivers as compared to a typical graphical display system. As each point-to-point data bus contains only the data for its corresponding column driver the instantaneous data rate to any column driver is lower than in conventional multi-drop architectures. The point-to-point system also has fewer printed circuit board (PCB) lines and a lower loop area than a conventional multi-drop system. A protocol may also be implemented. The protocol may provide for system level control and coordination of column driver and other display system components. This protocol allows the TCON to control the operation of the column drivers without the need for extra PCB lines.

FIG. 1 shows a Graphics Display System using a multi-drop data bus architecture between the panel timing controller (TCON) and the column drivers. In graphics display system 100, TCON receives pixel data, clock, and timing control from the Graphics Source and formats the data for display on the panel. The TCON transmits the data to column drivers 101–108 using a multi-drop data bus (110). The clock is connected to the column driver using a multi-drop bus (112). For n-bit data (i.e. 6-bit or 8-bit), there are typically 3*n data lines connecting to the TCON and each column driver. In some systems, there are up to 6*n data lines.

Figure 2:
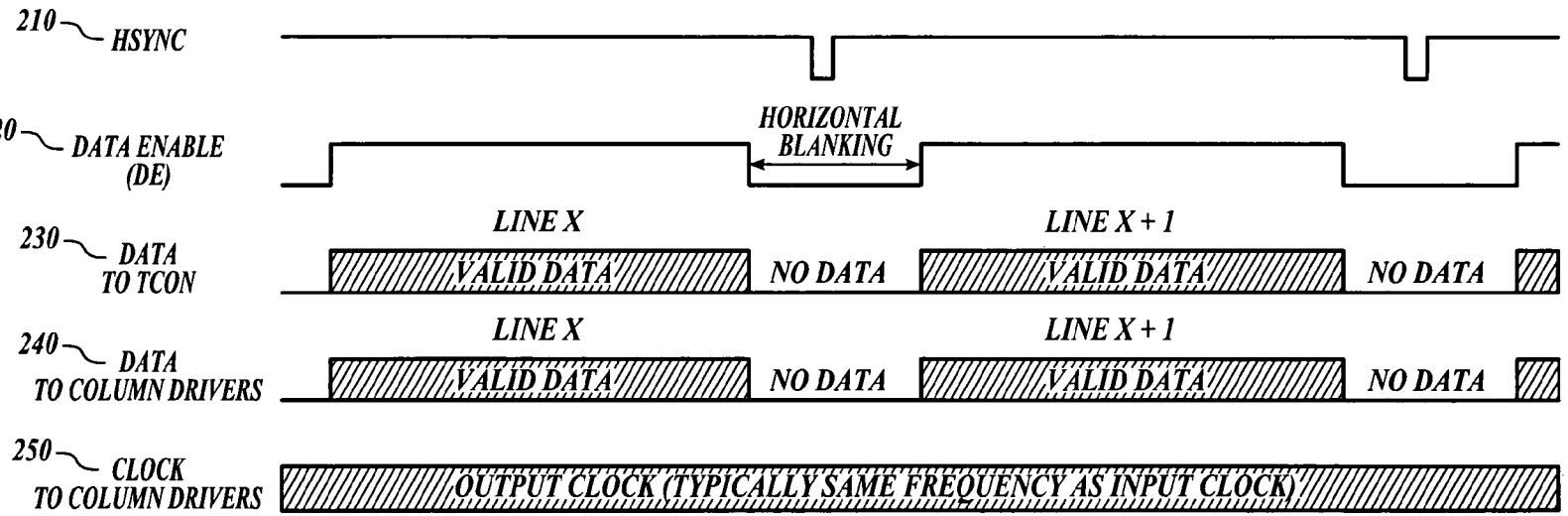
FIG. 2 shows typical horizontal line timing for a Graphics Display System using a multi-drop data bus architecture.

FIG. 2 shows typical horizontal line timing for a Graphics Display System using a multi-drop data bus architecture. As shown in FIG. 2, the TCON receives pixel data only when the Data Enable (DE) signal is high. No pixel data is received during the Horizontal Blanking period. As the data is received by the TCON, the TCON formats the data and transmits it to the column drivers on the multi-drop bus. No data, however, is transmitted to the column drivers during the Horizontal Blanking period. According to this system, the TCON's output clock to the column drivers is typically the same frequency as the clock received from the Graphics Source.

Graphics Display System using a Point-to-Point Data Bus

Figure 3:
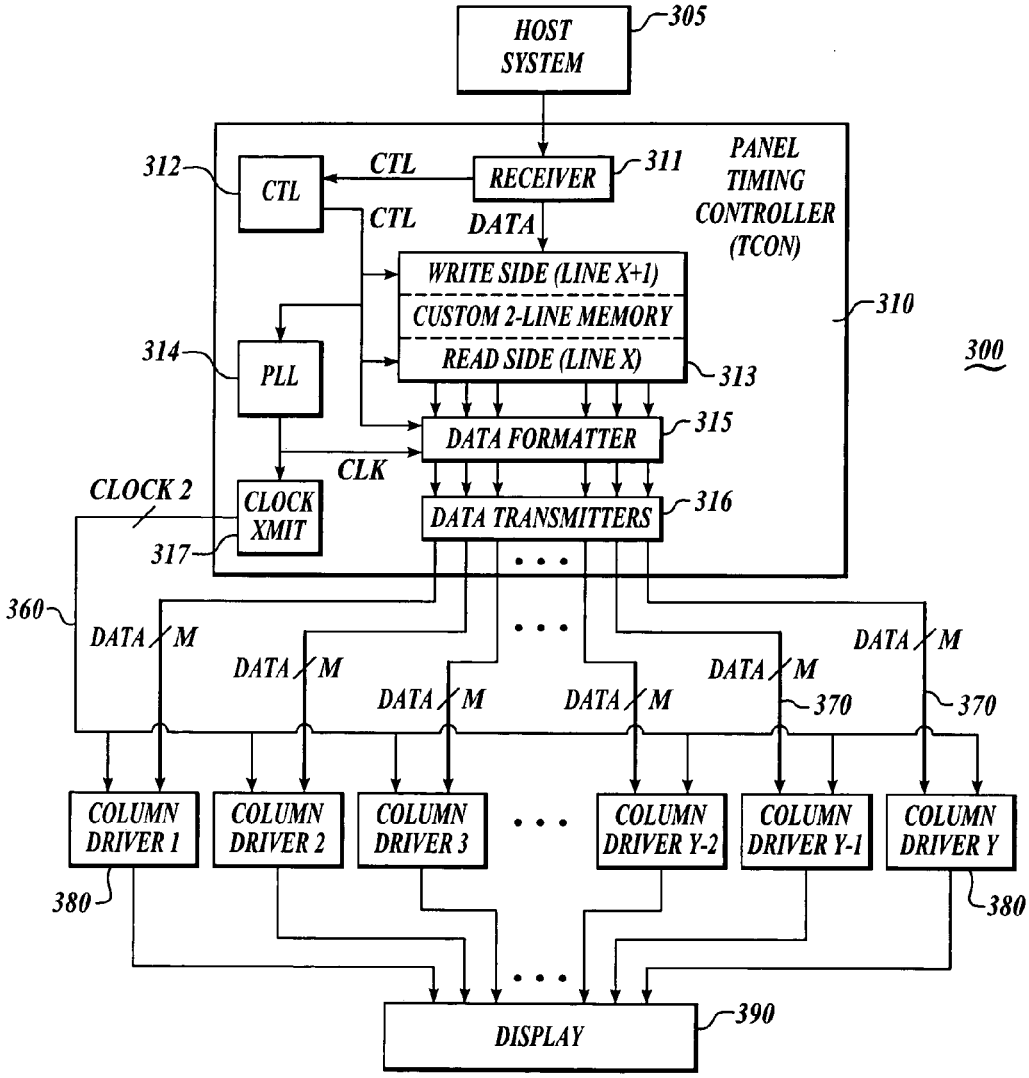
FIG. 3 shows a Graphics Display System using a point-to-point data bus architecture between the TCON and the column drivers.

FIG. 3 shows a Graphics Display System using a point-to-point data bus architecture between the TCON and the column drivers. As shown in the figure, graphics display system 300 includes host system 305, TCON 310, column drivers 380, and display 390. TCON 310 typically comprises receiver 311, control block 312, memory 313, PLL 314, data formatter 315, data transmitter 316, and clock transmitter 317.

Host System 305 may be any system (a computer, for example) that is suitable for generating data for display. Host System 305 typically comprises a CPU, RAM, ROM, a mass memory storage device (and/or network interface for accessing data stores), a power supply, a chassis, and the like.

TCON 310 formats data for display on display 390 in response to pixel data and control signals received from host system 305. Display 390 is typically a display panel and may be any display that use column or row drivers.

Receiver 311 provides control signals to control bock 312 and data to memory 313 in response to the pixel data and control signals (including a clock signal) received from host system 305. Control block 312 provides control signals to memory 313, PLL 314, and data formatter 315 in response to the control signals provided by receiver 311. Memory 313 is a line memory that stores data received from Receiver 311 and outputs stored data to data formatter 315 in response to control signals provided by control block 312.

Data transmitters 316 transmit the formatted data to column drivers 380 using separate point-to-point data buses 370 to transmit data to each driver 380. As can be seen by referring to graphics display system 300 there is a separate point-to-point data bus for each column driver. Each data bus 370 can be 2, 3, or 4 data lines wide, although other widths are possible. PLL 314 is used to provide a clock that is different from the clock provided by host system 305. Clock transmitter 317 transmits a clock signal to each driver 380 using multi-drop clock bus 360.

According to one embodiment of the invention, the point-to-point architecture uses a custom 2-line Memory in the TCON. The memory has 1 write port and 8 or more read ports. The number of read ports corresponds to the number of column drivers in the system. As the TCON receives the pixel data from the graphics source, the data is written into the line memory using the write port. While the pixel data for the current line is being written into the line memory, the pixel data for the previous line is being read out of the line memory. In other words, the data is read out of the line memory on each of the read ports simultaneously. The data from each read port consists of the data for its corresponding column driver.

The point-to-point architecture also utilizes a Phase Locked Loop (PLL) (314) to generate the output clock which is sent to each column driver (380). This clock is used by each column driver (380) to receive the pixel data from TCON (310) over the point-to-point data bus. The output clock generated by the PLL is typically at a lower frequency than the input clock received from the Graphics Source.

Advantages of the Point-to-Point Architecture

The Point-to-Point architecture shown in graphics system 300 has many advantages over conventional multi-drop graphics display systems.

Figure 4:
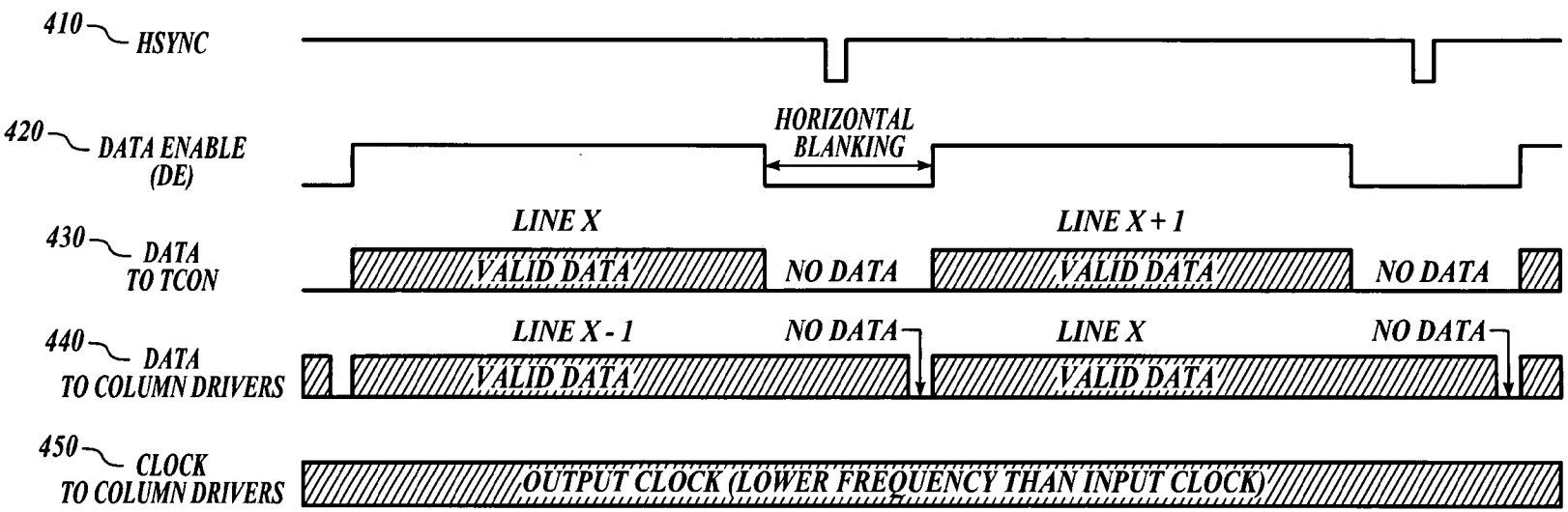
FIG. 4 illustrates transmitting data during a horizontal blanking period using a point-to-point data bus architecture.

FIG. 4 illustrates transmitting data during a horizontal blanking period using a point-to-point data bus architecture, in accordance with aspects of the invention. As illustrated in the figure, an exemplary horizontal sync signal (410), a data enable signal (420), a data to TCON signal (430), a data to column drivers signal (440) and a clock signal to column drivers (450) are shown. The use of the line memory and the PLL in the TCON aid in providing the ability to transmit data to the column driver during the Horizontal Blanking period.

Referring to tag 440, it can be seen that more data may be written to the column drivers as compared to a typical graphical display system.

Additionally, the clock to the column drivers may be at a lower clock frequency than the input clock frequency (See tag 450). Since each point-to-point data bus only contains the data for its corresponding column driver, the instantaneous data rate to any column driver is lower than in conventional multi-drop architectures. This results in lower power and lower EMI than conventional mufti-drop architectures.

Besides the power and EMI advantages, the point-to-point architecture offers physical advantages as well. The point-to-point system has fewer printed circuit board (PCB) lines and a lower loop area than a conventional multi-drop system.

Figure 5:
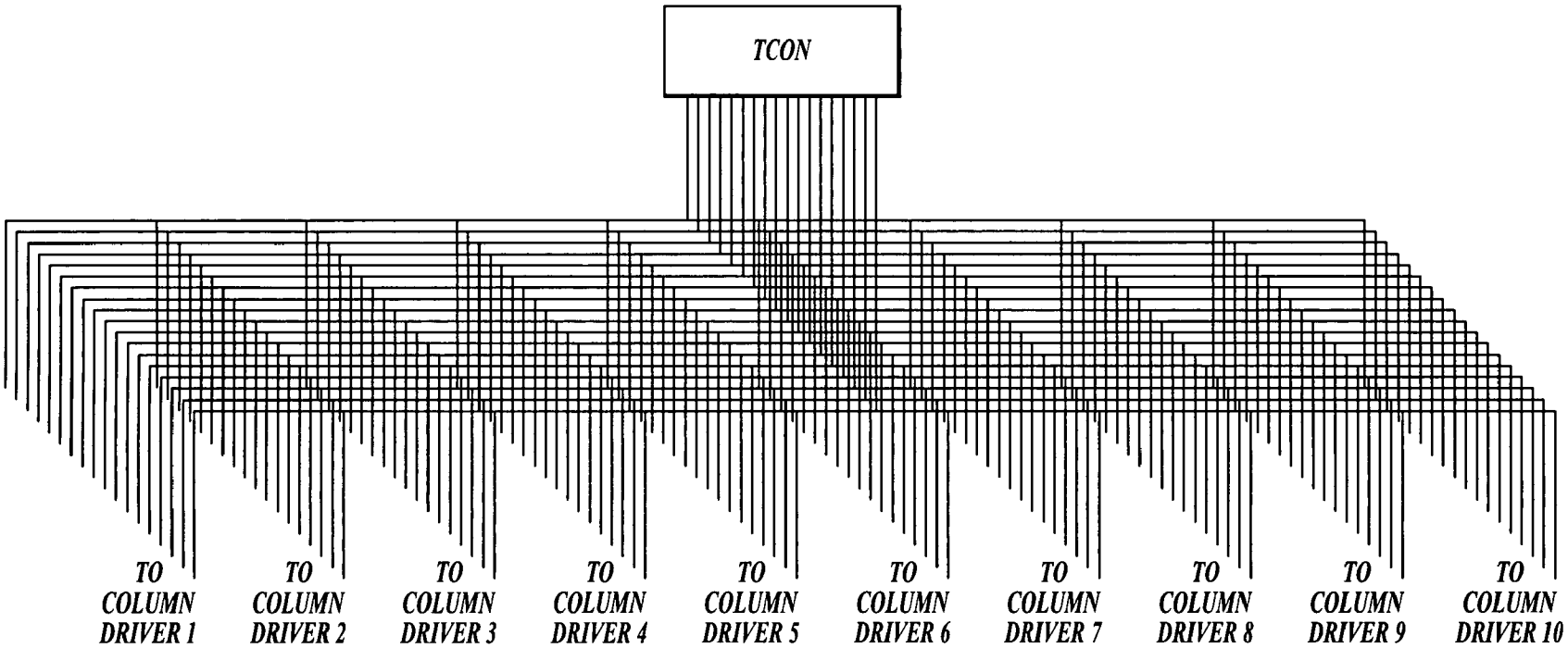
FIG. 5 shows the loop area of a typical multi-drop RSDS UXGA system using 18 multi-drop data lines from the TCON to the column drivers.

For example, FIG. 5 shows the loop area of a typical multi-drop RSDS UXGA system using 18 multi-drop data lines from the TCON to the column drivers.

Figure 6:
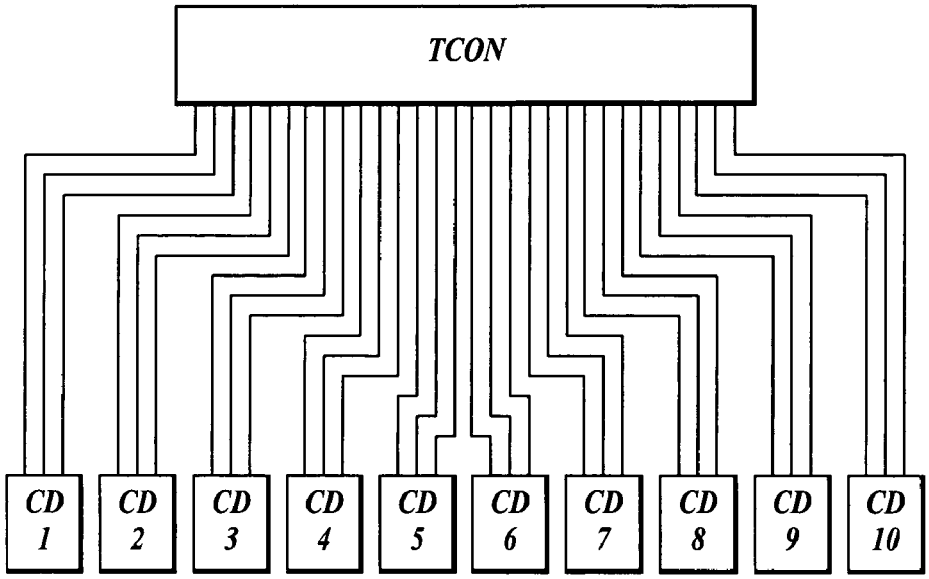
FIG. 6 shows a point-to-point UXGA system using 3 point-to-point data lines from the TCON to each column driver.

FIG. 6 shows a point-to-point UXGA system using 3 point-to-point data lines from the TCON to each column driver. As can be seen by comparing FIG. 5 with FIG. 6, the loop area of FIG. 6 is significantly reduced. The lower loop area reduces the cost of the PCB and also reduces the EMI. Additionally, it is easier to properly terminate a point-to-point PCB line than a multi-drop PCB line. The design illustrated in FIG. 6 results in fewer signal reflections and therefore better signal integrity as compared to FIG. 5. The point-to-point connection also allows true current mode receiver operation.

Figure 7:
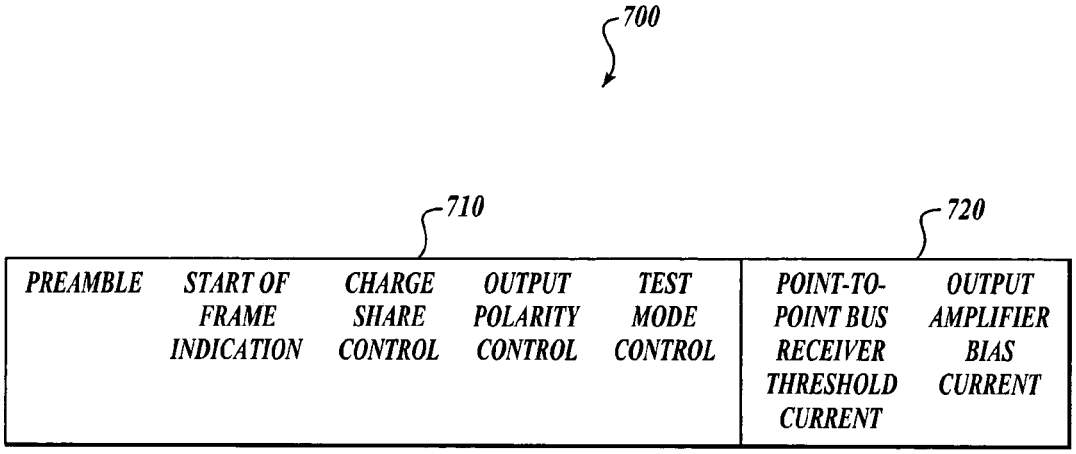
FIG. 7 illustrates a protocol for data transmission between the TCON and column drivers, in accordance with aspects of the invention.

FIG. 7 illustrates a protocol for data transmission between the TCON and column drivers. In addition to the advantages discussed above, the point-to-point architecture may incorporate a protocol for data transmission between the TCON and the column drivers. The ability to transmit data during the Horizontal Blanking period allows time for extra output clocks in which to implement a protocol. These extra clocks are generated by the PLL as shown in FIG. 3. According to one embodiment of the invention, the protocol provides for system level control and coordination of column drivers and other display system components.

Using a protocol, the TCON transmits control information in addition to the pixel data to the column driver. This protocol allows the TCON to control the operation of the column drivers without the need for extra PCB lines. Conventional graphics display systems, on the other hand, typically require one or more control lines (not used for data loading) from the TCON to each column driver.

As illustrated in the figure, protocol 700 contains digital control information 710 consisting of (but is not limited to) start of frame indication, charge share control, output polarity control, test mode control, and preamble. In addition to this digital control information, the protocol enables the TCON to transmit analog control information to the column driver as well. This analog control information (720) includes (but is not limited to) point-to-point bus receiver threshold current and output amplifier bias current.

The protocol also enables the column drivers to implement a de-skew algorithm which compensates for the skews between the clock and data that the column driver receives. This skew, which is caused by unmatched PCB impedances and trace lengths, is a problem in conventional graphics display systems and limits the frequency that data can be transmitted to the column drivers. The preamble portion of the protocol provides a means for each column driver to independently de-skew its data with respect to its clock. This enables the Point-to-Point system to achieve higher data rates per line without jeopardizing data integrity.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A system for displaying data, comprising:

a host system that is configured to provide data for displaying;

a display system timing controller (TCON) that includes an input coupled to receive the provided data, and outputs configured to transmit pixel data to column drivers during a horizontal blanking, period using separate point-to-point data busses; and a display that is configured to receive data from the column drivers.

2. The system of claim 1, further comprising an output clock circuit that is configured to provide an output clock to the column drivers, wherein the output clock is used by each of the column drivers to receive the pixel data from the TCON.

3. The system of claim 2, wherein the output clock is at a different frequency than an input clock received by the TCON.

4. The system of claim 3, wherein the output clock circuit comprises a PLL.

5. The system of claim 3, wherein the TCON further comprises a memory comprising a write port configured to receive the provided data and a read port for each of the column drivers configured to simultaneously output the received data.

6. The system of claim 5, further comprising while the provided data is being written to the write port, the received data is read out of the read ports.

7. The system of claim 5, wherein a data line width of the separate point-to-point data busses may be configured.

8. The system of claim 3, wherein the TCON is further configured to incorporate a protocol between the TCON and the column drivers.

9. The system of claim 8, wherein the protocol is employed over PCB lines used for the separate point-to-point data busses.

10. The system of claim 9, wherein the protocol comprises digital control information comprising a start of frame indication, a charge share control, a output polarity control, a test mode control, and a preamble.

11. The system of claim 9, wherein the protocol further comprises analog control information comprising a point-to-point bus receiver threshold current and an output amplifier bias current.

12. The system of claim 9, wherein the protocol is configured to implement a de-skew algorithm that compensates for skews between the output clock and data that the column drivers receive.

13. A method for data transmission between a timing controller (TCON) and a column driver, comprising:

employing a protocol over point-to-point data busses between the TCON and the column driver; wherein the protocol is transmitted during a horizontal blanking period; and providing control information within the protocol relating to displayed data.

14. The method of claim 13, wherein providing the control information further comprises providing digital control information.

15. The method of claim 13, wherein providing the control information further comprises providing analog control information.

16. The method of claim 14, wherein the digital control information further comprises a start of frame indication, a charge share control, a output polarity control, a test mode control, and a preamble.

17. The method of claim 15, wherein the analog control information further comprises a point-to-point bus receiver threshold current and an output amplifier bias current.

18. The method of claim 13, further comprising configuring the protocol to implement a de-skew algorithm that compensates for skews between an output clock and data that the column driver receives.

19. A system for displaying data, comprising:

means for providing data for displaying;

means for providing an output clock that is used by column drivers to receive pixel data at a different clock frequency than data is received by a TCON;

means for transmitting the pixel data to column drivers using separate point-to-point data busses during a horizontal blanking period; and means for a display to receive data from the column drivers.

* * * * *